United States Patent [19]

Faiks et al.

[11] 4,390,206

[45] Jun. 28, 1983

[54] SYNCHROTILT CHAIR CONTROL

[75] Inventors: Frederick S. Faiks, Greenville; Charles C. Pergler, Grand Rapids; Ronald L. Whitwam, Caledonia; Jack R. Knoblauch, Byron Center; Duane M. Beukema, Grand Rapids; Kenneth W. Hozeski, Grandville, all of Mich.

[73] Assignee: Steelcase, Incorporated, Grand Rapids, Mich.

[21] Appl. No.: 145,854

[22] Filed: May 1, 1980

[51] Int. Cl.[3] ..... A47C 1/032

[52] U.S. Cl. ..... 297/300; 297/304; 297/322; 248/561

[58] Field of Search ..... 297/313, 300, 301, 304, 297/305, 320, 322, 316

[56] References Cited

U.S. PATENT DOCUMENTS

| | | | |
|---|---|---|---|
| 2,321,385 | 6/1943 | Herold | 297/301 |
| 2,471,024 | 5/1949 | Cramer | 297/301 |
| 2,572,444 | 10/1951 | Cardon | 145/61 |
| 2,956,619 | 10/1960 | Scherer | 297/328 |
| 2,991,125 | 7/1961 | Lie | 297/306 X |
| 3,072,436 | 1/1963 | Moore | 297/304 |
| 4,076,308 | 2/1978 | Slabon | 297/313 |
| 4,214,726 | 7/1980 | Karrip et al. | 248/597 |

*Primary Examiner*—Francis K. Zugel

*Attorney, Agent, or Firm*—Price, Heneveld, Huizenga & Cooper

[57] ABSTRACT

The specification discloses a synchrotilt chair control in which a slide is provided between the front of the seat support and stationary control housing, which slide serves not only to make possible synchrotilt action between the back support and seat support, but also makes possible the incorporation of a seat adjustment assembly. The latter comprises a pivot bracket pivotally mounted on the slide and on the seat support, and an actuator for pivoting the pivot bracket. The pivotal mounting between the seat support and back support is also dual functional in that it supports a pivotally mounted lock plate for locking the control. A height adjustment actuator and hidden handle pretension adjustment bolt are also provided.

66 Claims, 32 Drawing Figures

SYNCHROTILT CHAIR CONTROL

BACKGROUND OF THE INVENTION

The present invention relates to synchrotilt chair controls. In synchrotilt controls, the chair back and the chair seat both tilt, and generally tilt together, but they tilt at different rates. The back tilts at a faster rate so that as one tilts back, he is less likely to have his feet lifted off of the floor by the rising front edge of the chair seat. In contrast, the other two common types of chair controls include one attached to the chair seat only such that the chair and back tilt at the same rate or one attached to the back only such that the back tilts, but the seat doesn't.

Synchrotilt chair controls typically have a stationary member with a resilient biasing means mounted in the stationary member. A chair back support means is usually pivotally mounted on the stationary member and is operably interconnected with the resilient biasing means. A chair seat support means is mounted on the stationary member and is operably connected to the chair back support means for rearward tilting with the chair back support means, but at a different rate with respect to it.

In order to provide for the differential rate of tilting between the chair seat and back, the chair seat support and the chair back support portions of the control must move relative to one another. Yet, they must be interconnected to one another so that the relative movements of the chair seat and back can be coordinated.

One way that prior artisans have achieved this result is to provide a toggle linkage between the rear of the seat support and the rear of the back support. Examples of prior art patents disclosing such a mechanism include the following:

Lie U.S. Pat. Nos. 2,991,125, issued July 4, 1961; Dufton 3,369,840, issued Feb. 20, 1968; Williams 3,402,964, issued Sept. 24, 1968; Lie 3,455,601, issued July 15, 1969; Kerstholt 3,602,537, issued Aug. 31, 1971; and Williams 3,672,721, issued June 27, 1972.

Another alternative employed by prior artisans is to provide a sliding connection between the rear of the seat support and the rear of the back support member. Examples of this approach include Sengpiel 2,447,601, issued Aug. 24, 1948; Moore 3,072,436, issued Jan. 8, 1963; and Pauquete 4,013,257, issued Mar. 22, 1977.

There are several important drawbacks to these prior art arrangements. The moving toggel linkage or slide between the rear of the seat support member and the rear of the back support member are subjected to tremendous loading forces and accordingly tend to wear out and otherwise operate inefficiently. The tremendous forces imposed on the rear of a chair control, either a seat supporting member or a back upright supporting member or both, are perhaps not totally appreciated by those skilled in the art. Hence, the prior art devices described above have not enjoyed any significant success.

At least one prior artisan has attempted to overcome this difficulty through the use of two separate torsion members in an attempt to distribute the loading forces. Anderson et al., U.S. Pat. No. 3,545,810, issued Dec. 8, 1970. Even so, the loads imposed at the rear of the seat support member and back upright support member are very high. Further, such mechanisms tend to be extremely cumbersome and complicated, as do the prior art mechanisms described above.

Another problem encountered with the arrangements described above is that a user may get the feeling as he leans back that the chair back and seat are separating from one another due to the slight shift between the seat support member and the back support member at the rear thereof. One prior artisan attempted to eliminate this uneasy feeling by pivotally joining the rear of the seat support to the chair back support and providing for sliding movement at the point at which the back support members are pivotally joined to the stationary chair control housing. Ciuffini et al., U.S. Pat. No. 3,240,528, issued Mar. 15, 1966. Unfortunately, that also is a heavily loaded point and accordingly, there may be a tendency for the sliding bearings to stick or wear out.

Another drawback is that such chair controls tend to be very complicated. The toggel or slide, for example is just one more single junction mechanical device on the mechanism which clutters it up. The addition of still further control features such as, for example, the locking cylinder of Lie 2,991,125 is almost unthinkable because of the resulting cluttered look.

SUMMARY OF THE INVENTION

The present invention comprises a revolutionary synchrotilt chair control which exhibits incredible economy of space and component function. Because of the unique arrangement of components a remarkable number of features can be provided in a single control.

The synchrotilt chair control of the present invention utilizes a slidable interconnection between the seat and the stationary member. However in the present invention, it is a dual function slide in that a unique seat adjustment assembly utilizes the same slidable connection to facilitate adjusting the seat angle. Preferably, this slide is located at the front of the chair, with the back of the seat support being directly pivotally connected to the back support. Not only is the slide dual function, but its preferred location subjects it to decreased wear and tear, the loads imposed at the front of a seat during rearward tilting being less than those at the rear.

In a narrower aspect of the invention, another feature is provided based on the pivot axle mounting between the seat support and back support. A control locking plate is pivotally carried on this pivot axle and an acutator can be operated to pivot it into operable engagement with the stationary member, thereby locking the chair control against any tilting action.

These and other unique features are all independent inventions in their own right, capable of operation in environments other than synchrotilt chair controls. They are so claimed in copending patent applications. However, they also cooperate in unique ways to create the revolutionary synchrotilt chair control of the present invention. These features, objects and advantages will be more fully understood and appreciated by reference to the written specification and appended drawings.

DESCRIPTION OF THE PREFERRED EMBODIMENT

A. BASIC ASSEMBLY

Figure 1:
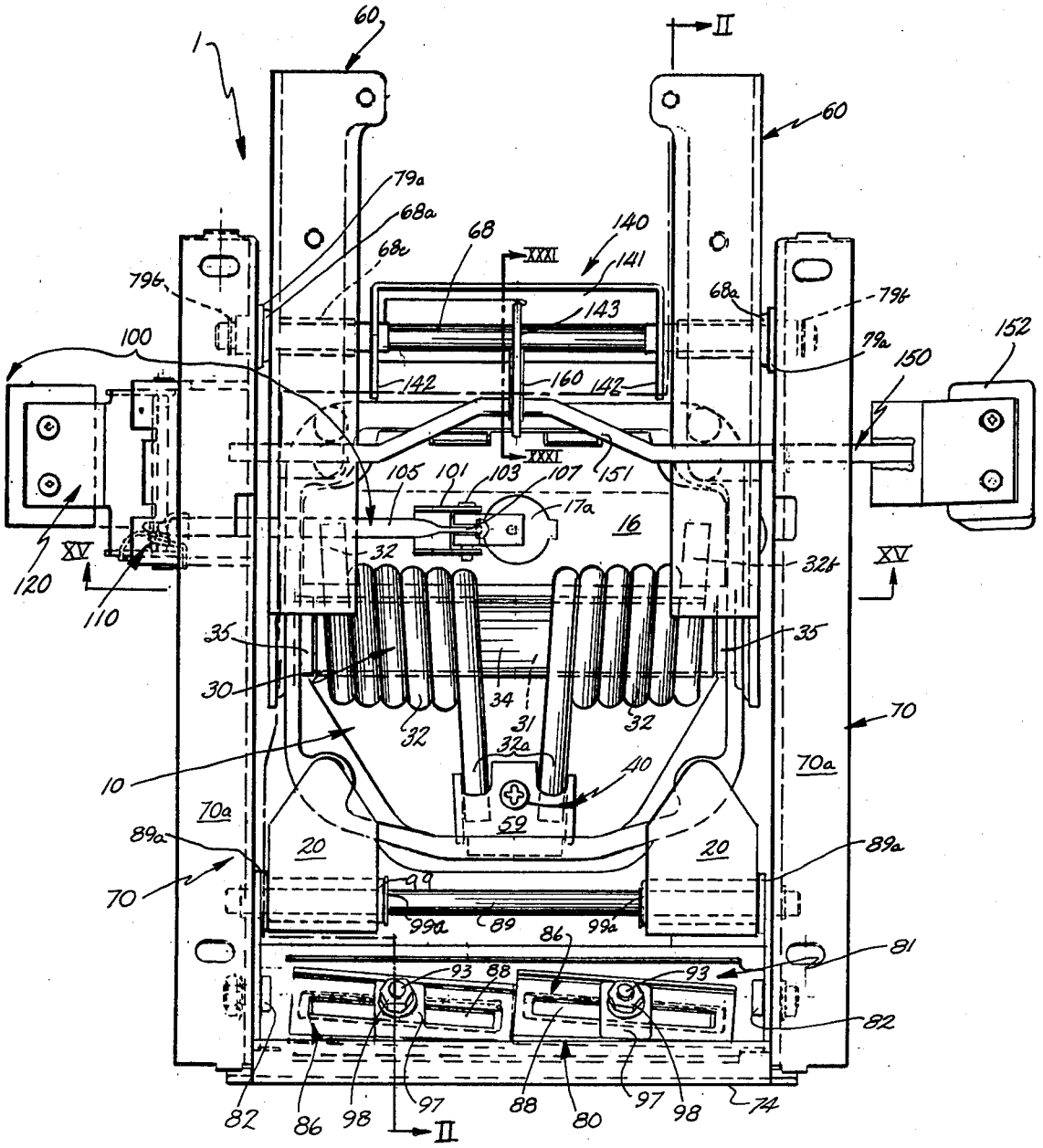
FIG. 1 is a plan view of a chair control made in accordance with the present invention.
Figure 2:
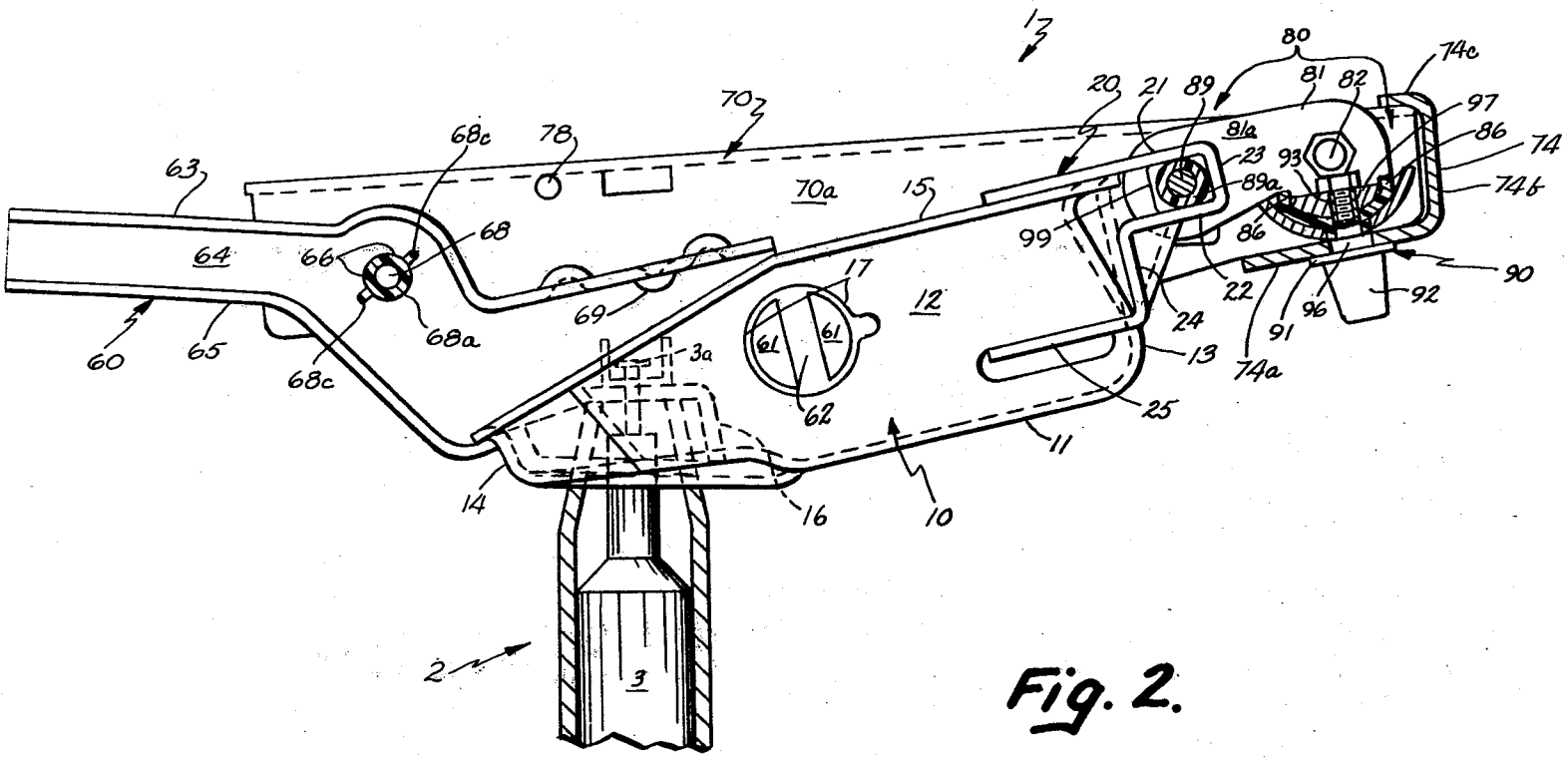
FIG. 2 is a fragmentary cross-sectional view taken generally along planes II—II of FIG. 1, showing only the right side seat support stretcher and back support arm (as viewed in FIG. 1) and eliminating the bias means 30, the tension bolt assembly 40, the pneumatic cylinder adjustment assembly 100, 110, 120 and 130, and eliminating the back upright lock assembly 140, 150 and 160.
Figure 3:
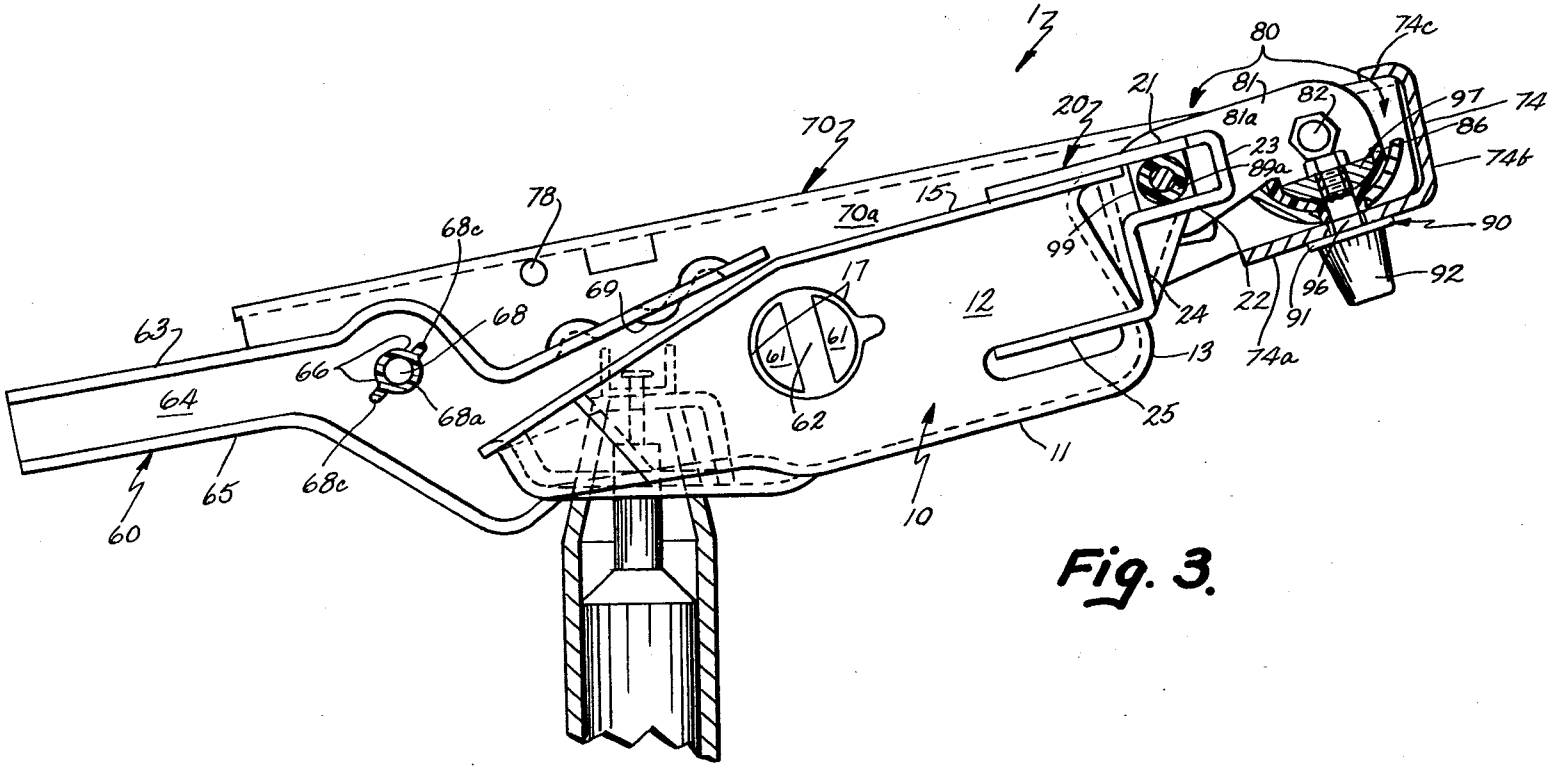
FIG. 3 is the same view as FIG. 2, but with the chair control in the position which it assumes when a person leans back in a chair to which the chair control is attached.
Figure 4:
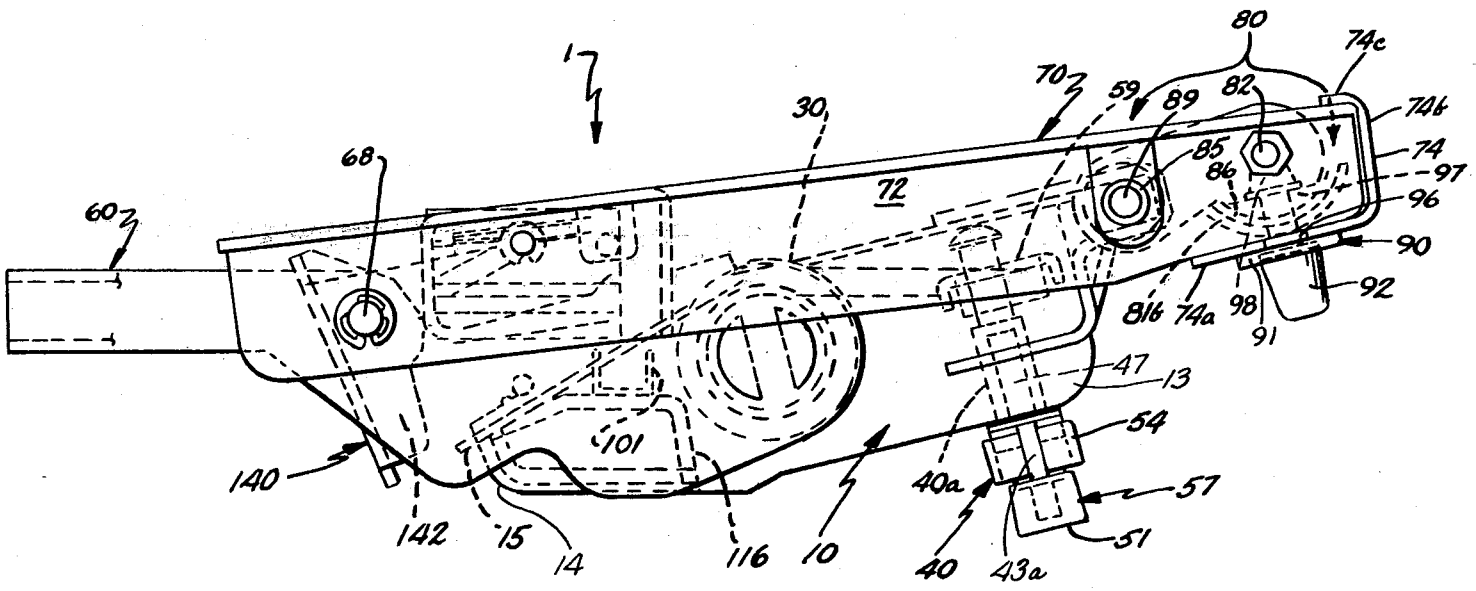
FIG. 4 is a side elevational view of the chair control with some of the internal components being shown in hidden lines.

FIGS. 1–4 illustrate the basic assembly of the preferred embodiment chair control 1. In FIGS. 2 and 3, it is shown mounted on a supporting column or spindle assembly 2. Chair control 1 comprises a stationary control housing 10 which houses a bias means 30 (FIGS. 1 and 4). The degree of pretension on bias means 30 is controlled by tension bolt assembly 40. Chair back support arms 60 are secured to the ends of the arbor 31 of bias means 30 and pivot with respect to stationary control housing 10. Chair seat support stretcher assembly 70 is pivotally mounted at its rear directly to back support arms 60. The front of seat support assembly 70 is slidably mounted within tracks 20 on the front of stationary control housing 10. This slidable mount is through a seat adjustment assembly 80 described more fully hereinbelow.

Chair control 1 also includes a pneumatic cylinder actuator assembly 100 for actuating the pneumatic cylinder 3 located within spindle assembly 2. The invention also contemplates in the preferred embodiment a chair control locking assembly 140 described more fully hereinbelow. This locks the control against tilting and thereby prevents the back upright and the seat from tilting.

Stationary control housing 10 is a stamped or otherwise formed metal dish having a bottom wall 11, side walls 12, a front wall 13 and rear wall 14 (FIGS. 2 and 3). A lip 15 extends around the upper periphery (see FIG. 2). There is an aperture in bottom 11 through which the upper end of spindle 2 extends. A spindle mounting plate 16 is welded to the inside of housing 10 and includes an aperture 17*a* therein to also receive the upper end of column assembly 2 (FIGS. 1 and 2).

Projecting forwardly from front wall 13 are a pair of track brackets 20. These are formed of metal by bending them so as to define a top wall 21, a bottom wall 22 and a front wall 23. These basically define the track in which seat support assembly 70 is slidably mounted. Extending downwardly from bottom wall 22 is a front brace 24 and then bent inwardly from front brace 24 to form the bottom brace 25. The rear portion of the top wall 21, front brace 24 and bottom brace 25 are welded to stationary control housing 10 to hold track brackets 20 in place.

Bias means 30 comprises a torsional coil spring arrangement. An arbor 31 which is generally circular in cross sectional configuration extends through holes 17 in side walls 12 of stationary control housing 10 (compare to FIGS. 1 and 2). Arbor 31 is actually hidden in FIG. 1 since it is covered by a plastic sleeve 34. The ends of arbor 31 are rotatably carried in end bearings 35 which are located within side wall holes 17. Coiled around arbor 31 and sleeve 34 are a pair of coil springs 32. The front ends 32*a* of coil springs 32 are captured under retainer nut 59 of tension bolt assembly 40, captured in notches and between the side walls thereof. The rear ends 32*b* of springs 32 are captured under the chair back support arms 60. Tension adjustment is achieved by tightening or loosening tension bolt 40 in retainer nut 59. Basically, tension adjustment bolt assembly 40 comprises a bolt 40*a* having a hollow shank normally housing a lever 47. One can grasp gripping cap 51, retract lever 47, pivot it to one side into a slot 43*a* and rotate it to thread bolt 40*a* up or down in retainer 59.

Chair back support arms 60 are formed of metal and are preferably channel shaped in cross section having a top wall 63, a side wall 64 and a bottom wall 65 (FIG. 2). There are two such chair back mounting arms 60, one located on either side of stationary housing 10 (FIG. 1). The generally channel shape cross section allows one to slip a chair back support frame or arm into the channels.

The arbor mounting hole or holes 61 in the side wall 64 of chair back support arm 60 is visible through the hole 17 in the side of stationary housing 10 in FIG. 2. There are two semi-circles 61 spaced by a bridge 62. The ends of arbor 30 are slotted so that they fit into the semicircles 61. In this way, chair back support arms 60 are fixed against rotation with respect to arbor 30 and as one tilts back in the chair, chair back support arms 60 pivot and arbor 30 rotates within its plastic end bearings 35.

On top wall 63 of each support arm 60, located toward the front thereof are a pair of downwardly projecting dimples or protrusions 69 (FIG. 2). The rear end 32*b* of each coil spring 30 is captured between dimples 69. The other protrusions shown projecting up from top wall 63 are merely reinforcing ribs.

Located about midway along the length of each chair back support arm 60 is a hole 66 which is adapted to receive the rear axle 68 and suitable bearing 68*a*. It is on the rear axle 68 that the rear of chair seat support assembly 70 is pivotally carried.

The chair seat support assembly 70 comprises a pair of spaced stretchers 70*a* joined at the front by front piece 74 (FIGS. 1, 2, 5 and 6). Each side stretcher 70*a* is formed of steel to define a top ledge 71 and a side wall 72. There are mounting holes 76 in top ledges 71 to facilitate mounting chair control 1 to the bottom of a chair seat. Located in one side stretcher 70*a* is a push rod hole 77 through which the push rod 105 of pneumatic cylinder adjustment assembly 100 extends. There is an aperture 78*a* in the same side stretcher and a similar aperture 78 in the other side stretcher 70*a* through which the back upright lock rod 150 extends.

Located towards the rear of each side wall 72 of each stretcher 70*a* is a rear axle receiving hole 79 (FIG. 6) which receives the end of rear axle 68 carried in a suitable plastic bearing of "T" shaped longitudinal cross section 79*a* (FIG. 1). Of course, suitable retainer clips 79*b* or the like then hold rear axle 68 in position (hidden in FIG. 1).

The front piece 74 which is welded to and thereby joined to side stretchers 70*a* is generally "J" shaped having a bottom wall 74*a*, a front wall 74*b* and a top lip 74*c*. Bottom wall 74*a* includes a pair of spaced slots 75 therein for cooperating with components of seat adjustment assembly 80. One slot is located towards one side stretcher 70*a* and the other slot towards the other.

Figure 6:
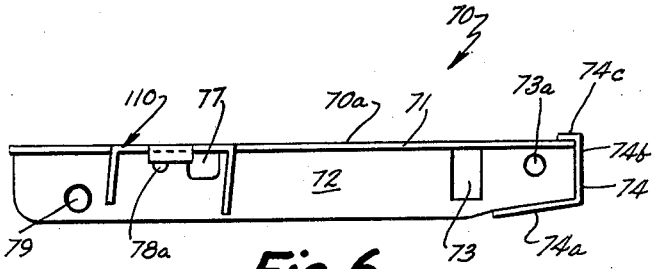
FIG. 6 is a side elevational view thereof.

A large generally rectangular opening 73 is provided towards the front of each side wall 72 of each stretcher 70*a*. (FIGS. 4 and 6). These facilitate sliding of axle 89 in tracks 20 without interference and also facilitate cooperation with seat adjustment assembly 80. The forwardmost holes 73*a* in each side wall 72 of each stretcher 70*a* similarly facilitate mounting of seat adjustment assembly 80 to stretcher assembly 70. The details of this cooperation are set forth more fully hereinbelow.

B. SEAT ADJUSTMENT ASSEMBLY

Seat adjustment assembly 80 comprises first of all a pivot bracket 81 which is pivotally mounted between side stretchers 70*a* of stretcher assembly 70 via pivot nut, bolt and washer assemblies 82 through holes 73*a* (FIGS. 1, 2, 7 and 8). Pivot bracket 81 comprises a pair of spaced, short legs 81*a* joined by a cylindrical bottom wall 81*b*. Cylindrical wall 81*b* defines at least a portion of the wall of a right circular cylinder having its axis of revolution on the pivot axis between bracket 81 and seat support assembly 70. All are formed of metal and are welded together or alternatively formed from a single piece.

Figure 7:
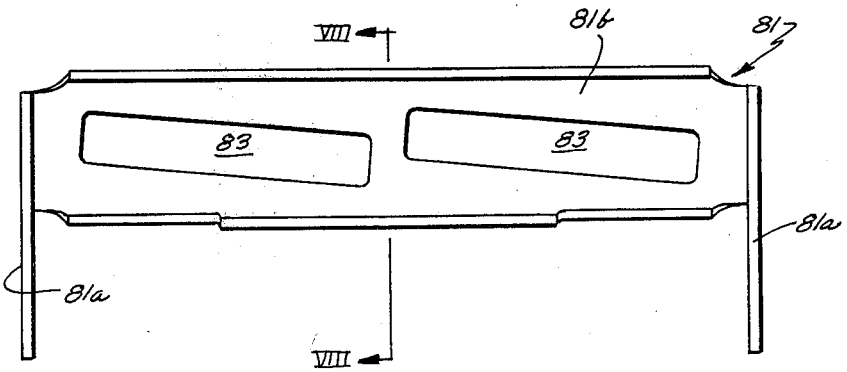
FIG. 7 is a top plan view of the seat adjustment pivot bracket 81.
Figure 8:
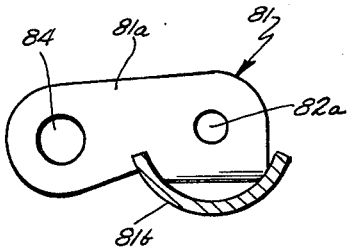
FIG. 8 is a cross sectional view thereof taken along plane VIII—VIII of FIG. 7.
Figure 9:
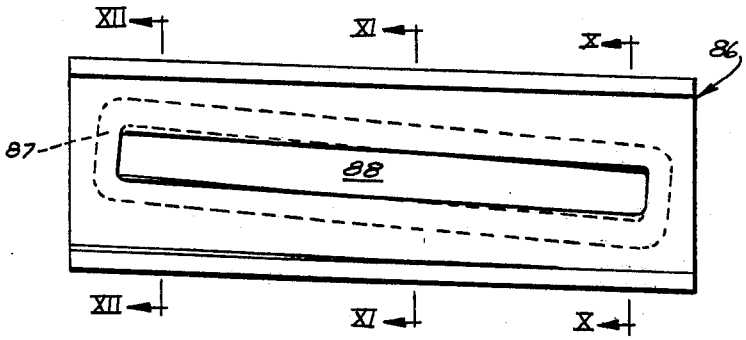
FIG. 9 is a top plan view of the pivot bracket insert 86.
Figure 10:
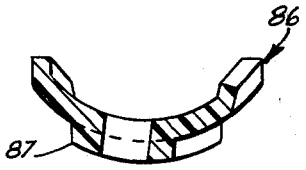
FIG. 10 is a cross sectional view thereof taken along plane X—X of FIG. 9.
Figure 11:
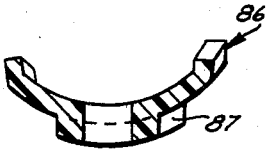
FIG. 11 is a cross sectional view thereof taken alone plane XI—XI of FIG. 9.
Figure 12:
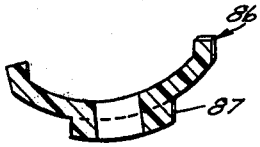
FIG. 12 is a cross sectional view thereof taken alone plane XII—XII of FIG. 9.

The hole 82*a* towards the front of each side wall 81*a* through which the bolt of nut, bolt and washer assembly 82 passes can be seen in FIG. 8. Referring to FIG. 7, it will be seen that there are a pair of spaced slots 83 in bottom wall 81*b* of pivot bracket 81. Each slot 83 is generally spirally or helically oriented in the cylindrical bottom wall 81*b*. When pivot bracket 81 is pivotally secured in position in seat support stretcher assembly 70, helical slots 83 line up above slots 75, with bottom wall 81*b* possibly but not necessarily contacting bottom wall 74*a* of front piece 74 of seat support assembly 70. However, slots 83 are slanted relative to slots 75 such that they overlap only at selected points at any given time.

The particular points at which slots 83 line up with slots 75 is determined by adjustment slide 90 (FIGS. 2, 4, 13 and 14). Adjustment slide 90 comprises a flat bottom plate 91 having a gripper flange 92 projecting downwardly from the bottom thereof. Protruding upwardly from bottom plate 91 are a pair of spaced bolts 93. Bottom plate 91 including gripper 92 is molded of plastic and bolts 93 are square cross section shoulder bolts which are molded in place in the plastic. A raised locating shoulder 96 around each bolt 93 is alo integrally molded of the plastic material with plate 91 and gripper 92.

In assembly, bolts 93 project upwardly through slots 75 and 83, with each locating shoulder 96 fitting snuggly within one of said slots 75 in the bottom wall 74*a* of front piece 74 of seat support assembly 70. More specifically, the square cross sectioned shank 95 of each bolt 93 extends upwardly through the slot 88 in a molded plastic pivot bracket insert 86 (FIGS. 9–12 as well as FIGS. 1, 2, and 4). Pivot bracket inserts 86 are made of self lubricating type of plastic such as a glass reinforced nylon in order to minimize friction in the seat adjustment assembly. It will be noted that each insert 86 is cylindrical in cross sectional configuration so that it seats snuggly against the cylindrical cross sectional configuration of the bottom wall 81*b* of pivot bracket 81. The slot 88 in pivot bracket insert 86 is similarly helical in shape so that it matches with slot 83. It will be further noted that each slot 88 is framed by a peripheral, downwardly projecting lip 87 which actually extends into and through the receiving slot 83. The helical configuration of lip 87 can be appreciated by reference to the three cross sections shown in FIGS. 10, 11 and 12.

Figure 13:
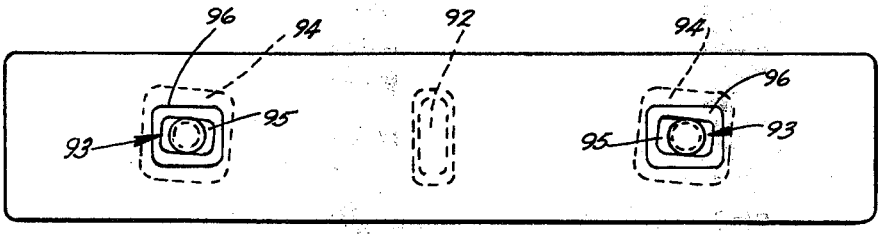
FIG. 13 is a top plan view of the seat adjustment slide 90.
Figure 14:
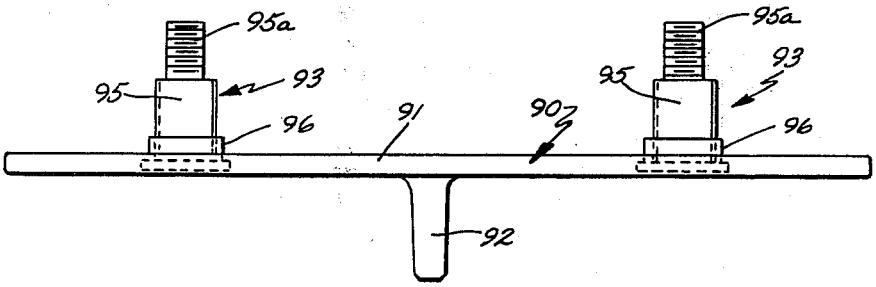
FIG. 14 is a side elevational view thereof.

Because of the difference between the generally rectilinear slot 75 in seat support front piece 74 as distinguished from the helical slot 88 in pivot bracket inserts 86, it will be noted by reference to FIG. 13 that the plastic guide or locating shoulders 96 at the base of each upwardly projecting bolt 93 are generally rectangular in configuration and are oriented parallel to the longitudinal axis of seat adjustment slide 90. Thus, these locating shoulders 96 sit nicely in slots 75 and slide readily from one end thereof to the other.

However, the generally rectangular shank or shoulder 95 of shoulder bolts 93 are cocked at a slight angle with respect to the longitudinal axis of slide 90. This is accomplished by embedding shoulder bolts 93 at a cocked angle that can be seen from the outline of the heads 94 of the bolts which are embedded in the plastic of bottom plate 91. These cocked, generally rectangular shanks or shoulders 95 then fit readily into slots 88 and slide readily along the length thereof.

Projecting upwardly from the cocked shoulder 95 of bolts 93 are the threaded upper ends 95*a*. Referring to FIGS. 1, 2 and 4, it will be understood that a washer of generally solid semi-cylindrical lateral cross section fits over the threaded portion 95*a* of each bolt 93 and the cylindrical wall portion of each washer 97 seats down in the cylindrical nest defined by pivot bracket inserts 86. Flanged nuts 98 are then threaded down onto threaded ends 95*a* of bolts 93. The components are dimensioned or adjusted such that washer 97 rests on top of shoulder or shank 95 without tightening pivot bracket inserts 86 and pivot bracket 81 too tight against bottom wall 74*a* of seat stretcher front piece 74. This allows one to slide seat adjustment slide 90 to the left or to the right relative to the front of chair control 1, thereby changing that portion of slots 88 and 83 which overlie the longitudinally oriented slots 75 of seat stretcher front piece 74. In effect, this causes pivot bracket 81 to rotate about its pivotal mounting via nut, washer and bolt assemblies 82 to seat stretcher assembly 70. Such rotation shifts the elevation of the left end of each leg 81*a* of pivot bracket 81 with respect to the side stretchers 70*a* of seat stretcher assembly 70.

The purpose of this change in elevation is to change the effective angle or elevation of the front of a chair seat mounted on chair control 1. Located at the left end as viewed in FIGS. 2, 4 and 8, of pivot bracket 81 is an axle receiving hole 84. A front slide axle 89 extends through the axle receiving holes 84 in the opposite pivot bracket legs 81*a*. The ends of the axle 89 are carried in suitable bearings 89*a*.

Axle 89 passes through the lateral openings in track brackets 20 at the front of stationary control housing 10 whereby pivot bracket 81 is pivotally mounted to stationary housing 10. Within the confines of each track bracket 20, axle 89 is carried in a plastic bushing 99 of generally rectangular cross section (FIGS. 1 and 2). Retainer clips or rings 99*a* (FIG. 1) hold the plastic bushing 99 and axle 89 in position within track brackets 99. With the ends of pivot bracket legs 81*a* thus assembled to the front of stationary control housing 10, the pivoting of pivot bracket 81 by changing the position of slide 90 thereby changes the elevation of the front of seat support assembly 70 with respect to the front of stationary control housing 10. This then facilitates adjustment of the seat angle by the user of the chair to which chair control 1 is mounted.

Bushings 99 are preferably formed of a self lubricating plastic material of the type commonly used to minimize friction. An example of such a plastic would be the acetal type, available from Dupont as "Delrin" TM, and from Celenese as "Celcon" TM. This enables bushings 99 to slide along the length of track brackets 20.

Such sliding action takes place when the user of a chair to which chair control 1 is mounted leans back in the chair. In leaning back, he causes chair back support arms 90 to pivot about their pivot point with respect to stationary housing 10. Similarly, chair seat support assembly 70 tilts rearwardly since it is pivotally connected directly to back support arms 60 at axle 68. At the same time, front axle 89 and bushings 99 slide rearwardly within track brackets 20. The enlarged openings 73 in the side stretchers 70*a* allow clearance for the ends of axle 89 to move up and down and slide. A comparison of chair control 1 in its untilted and tilted back positions respectively can be seen by comparing FIGS. 2 and 3.

Also, the sliding interconnection between stationary member 10 and pivot axle 89 allows pivot axle 89 to shift as pivot bracket 81 is rotated. At some point, there has to be means allowing at least one connection between said housing 10 to shift vis-a-vis seat support 70 when pivot bracket 81 is rotated.

C. TENSION ADJUSTMENT ASSEMBLY

Figure 25:
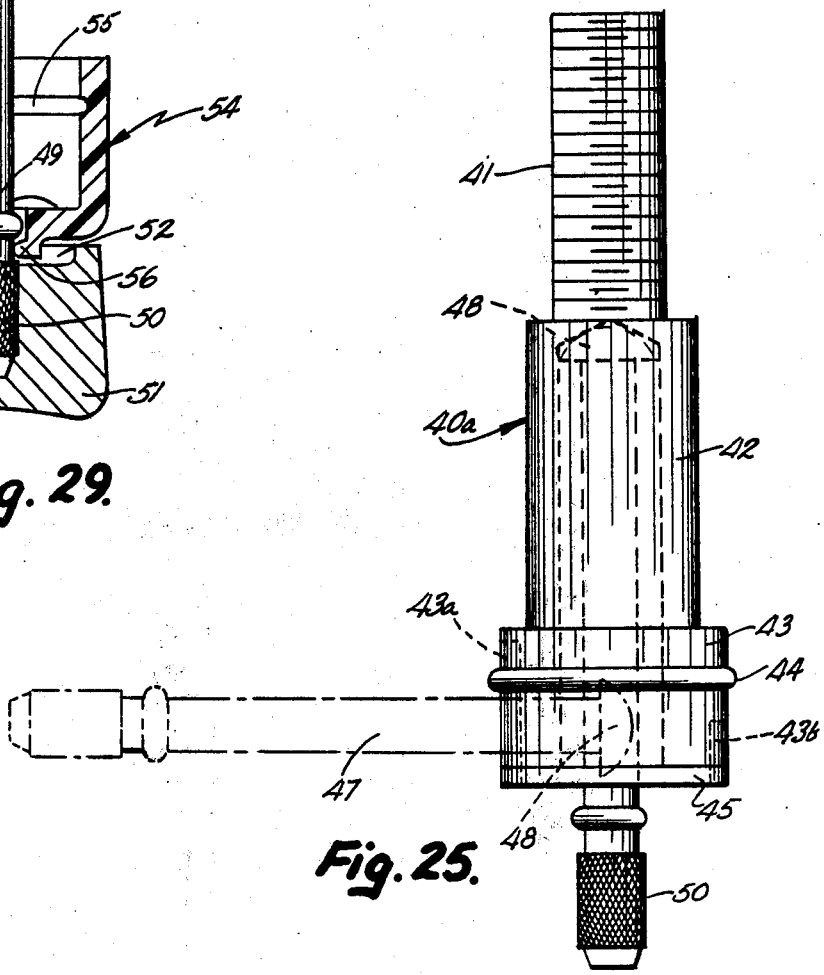
FIG. 25 is an elevational view of portions of the tension bolt assembly 40.
Figure 26:
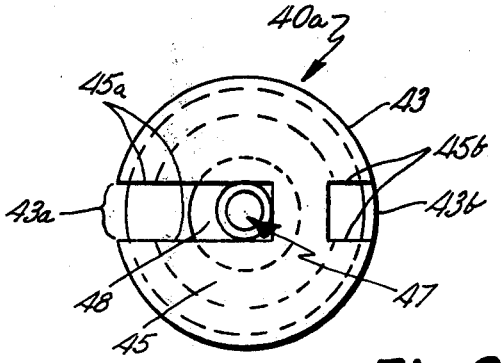
FIG. 26 is a top plan view of that shown in FIG. 25.

Tension adjustment assembly 40 comprises a threaded bolt assembly 40*a* which extends through the bottom of stationary housing 10 and is threaded into a threaded retainer nut 59 (FIG. 4). Referring to FIGS. 25, it will be seen that adjustment bolt 40*a* comprises a threaded end 41 which projects from a hollow tubular shank 42. There is an enlarged head 43 at the end of hollow shank 42 and there are a pair of spaced slots 43*a* and 43*b* on opposite sides of head 43 (FIG. 26).

Positioned within hollow shank 42 is an elongated lever 47 having an enlarged retainer head 48. Lever 48 is free to slide in and out of hollow shank 42 and can be extracted from its position as shown in solid and hidden lines in FIG. 25 to the lateral position shown in phantom lines in FIG. 25. In the lateral position, lever 47 is seated within and extends through the large slots 43*a* on one side of head 43.

In order to prevent lever 47 from falling completely out of the hollow interior of shank 42, a slotted washer 45 is welded to the open top of head 43. It includes a relatively long slot 45*a* which extends from beyond its center to one edge and which, in assembly, is aligned with slot 43*a* in the side of head 43. Another shorter slot 45*b* extends from the opposite side of washer 45 and aligns with slot 43*b* in head 43 of bolt 48. It can be seen that slot 43*a* allows one to pull lever 47 into an extended position and fold it over so that it extends through slot 43*a*, but does not allow the enlarged head 48 to be retracted from the assembly since slot 45*a* is narrower than the width of enlarged head 48.

Figure 29:
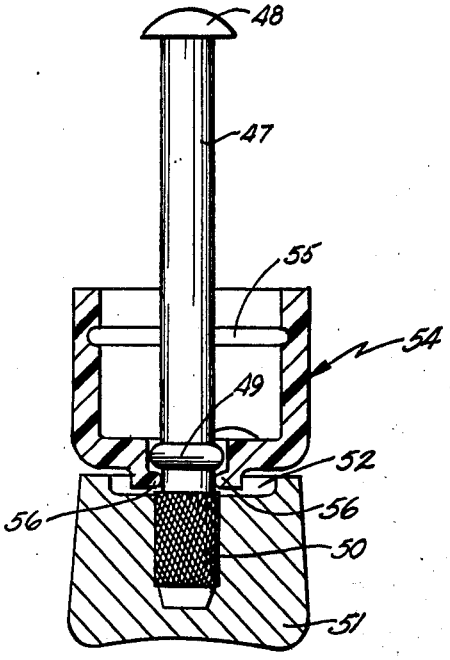
FIG. 29 is a cross sectional view of the adjustment cap assembled with the actuating lever 47.
Figure 27:
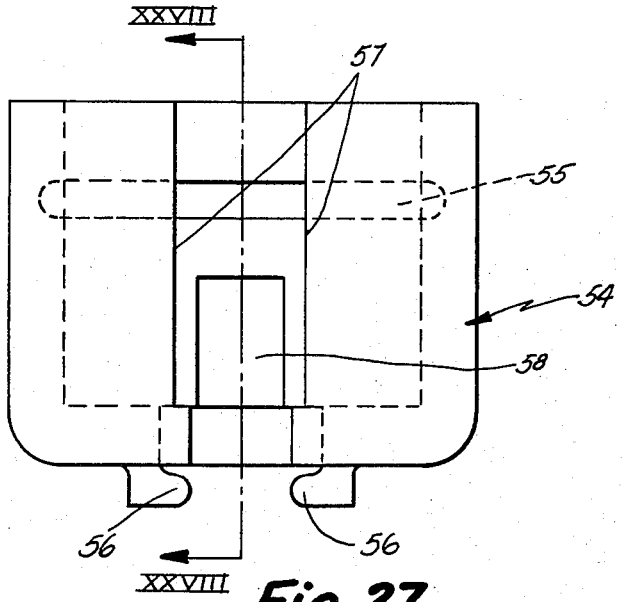
FIG. 27 is an elevational view of the adjustment cap.
Figure 28:
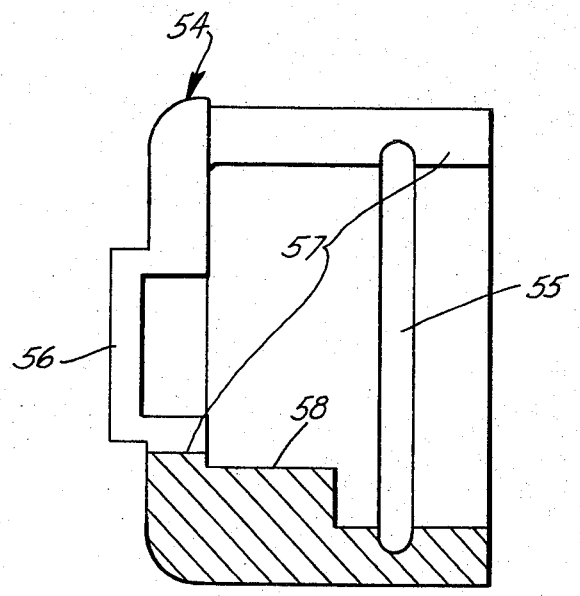
FIG. 28 is a cross sectional view of the adjustment cap taken along plane XXVIII—XXVIII of FIG. 27.

Enlarged head 43 of bolt 40*a* includes an annular rib 44 projecting from the exterior surface thereof. This facilitates mounting a plastic cap 54 over head 43 (FIGS. 27, 28 and 29). Cap 54 includes an inner annular groove 55 which seats over projecting annular rib 44 and thereby holds cap 54 in position on enlarged head 43.

Cap 54 also includes an enlarged slot 57 which extends completely up one side and through the top of the cap all the way beyond its center and almost to the opposite side (FIGS. 27 and 28). Slot 57 is intended to line up with slots 43*a* and 45*a* so that the presence of cap 54 on head 43 does not hinder the action of lever 47 as illustrated in FIG. 25.

In order to align slot 57 properly, cap 54 includes an inwardly projecting tab 58. Tab 58 is located directly opposite slot 57 and seats within slots 45*b* and 43*b* on head 43 to thereby insure that slot 57 will be properly aligned with slots 43*a* and 45*a*.

Other than aesthetics, the primary purpose of cap 54 is to retain lever 47 in its normally stored condition as illustrated in FIGS. 4 and 25. Lever 47 includes its own annular rib 49 near its end opposite retainer head 48. Cap 54 includes an annular lip 56 extending around a top central opening. Top lip 56 and annular rib 49 are dimensioned such that annular rib 49 can be forced past lip 56 in either direction, but the fit is a snug one such that absent application of force, annular rib 49 will be retained behind lip 56 to thereby hold lever 47 in its up position as indicated in FIG. 4 and FIG. 29.

Lever 47 includes a knurled end 50. This receives a plastic gripping head 51 which has a hollow core to fit snuggly over knurled end 50. The bottom (or top depending on your point of view) of gripping head 51 is hollowed out to define a shallow recess 52. The purpose of recess 52 is to fit over and cover the downwardly protruding lips 56 of cap 54 when lever 47 is seated in its normally stored position as illustrated in FIG. 29. The reason lips 56 project downwardly below the level of the rest of the body of cap 54 and then inwardly is that such positioning renders them somewhat more flexible, enabling them to be dimensioned more snuggly around the main body of lever 47 and still allow them to be flexed to one side as annular rib 49 passes.

The threaded end 41 of bolt 40*a* is threaded into a threaded opening in retainer nut 59. When one wants to adjust the pretension of bias means 30, one grips gripping head 51, pulls lever 47 downwardly and then pivots lever 47 to one side until it is located so as to pass through slot 43*a* (FIG. 25). One then applies a force to the end of lever 47 and thereby rotates adjustment bolt 40*a*, causing it to thread upwardly or downwardly in retainer nut 59.

Figure 30:
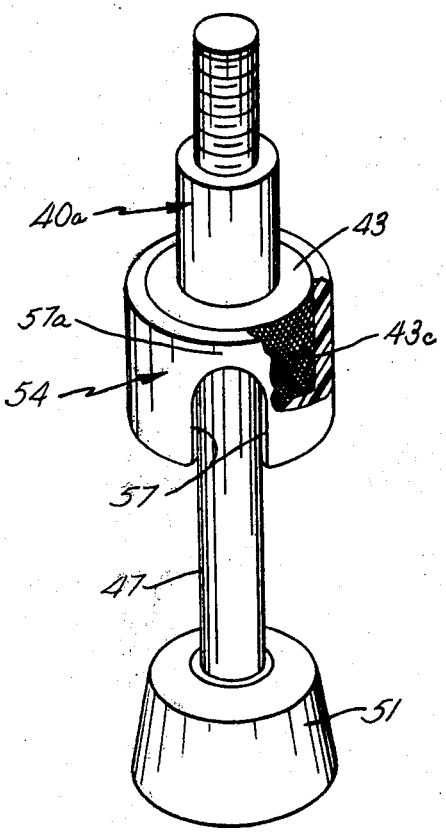
FIG. 30 shows an alternative cap and means for securing it to bolt 40*a*, with a portion of the cap broken away.
Figure 31:
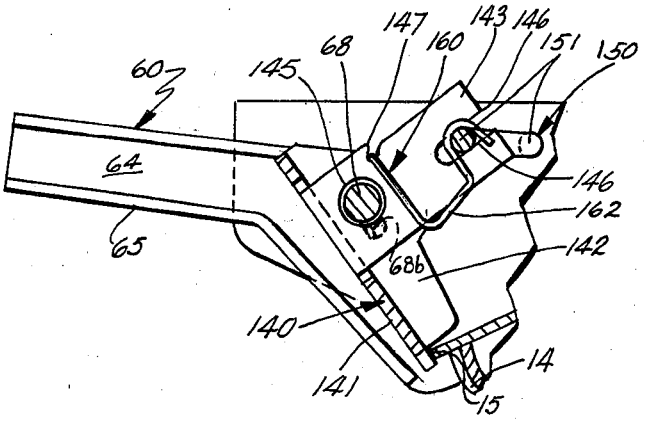
FIG. 31 is a fragmentary, sectional view taken along plane XXXI—XXXI in FIG. 1 showing the chair back locked in its upright position.
Figure 32:
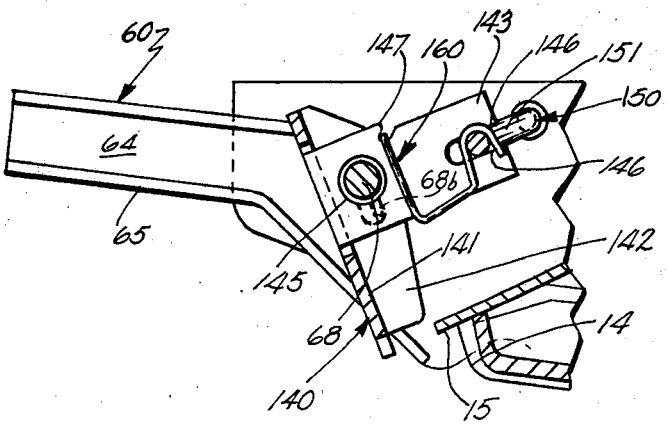
FIG. 32 is a fragmentary, sectional view taken alone plane XXXI—XXXI in FIG. 1 showing the locking plate positioned to permit tilting of the chair back.

FIG. 30 discloses an alternative and indeed most preferred means for securing cap 54 to bolt 40*a*. The differences in the FIG. 30 embodiment over that described above are:

1. elimination of rib 44 and groove 55;
2. addition of a knurled surface 43*c* on head 43; and
3. closing of slot 57 in cap 54 at the base thereof by a bridge 57*a* of plastic material.

With slot 57 closed by bridge 57*a*, cap 54 can now be force fitted onto head 43. Knurled surface 43*a* digs into the interior plastic surface of cap 54 and holds cap 54 in place on head 43. This eliminates the need for rib 44 and groove 55.

D. PNEUMATIC CYLINDER ACTUATOR

Pneumatic cylinder adjustment assembly 100 is designed for use in conjunction with a pneumatic cylinder pedestal base of the type shown in FIG. 2. A pneumatic cylinder 3 is housed within a hollow sleeve or column 2. At the top end of pneumatic cylinder 3 is an actuator button 3*a*. When one depresses acutator button 3*a*, one allows the piston rod to expand outwardly with respect to its cylinder; or alternatively if weight is applied to the chair upon which control 1 is mounted, one compresses the piston rod into the cylinder 3.

Figure 15:
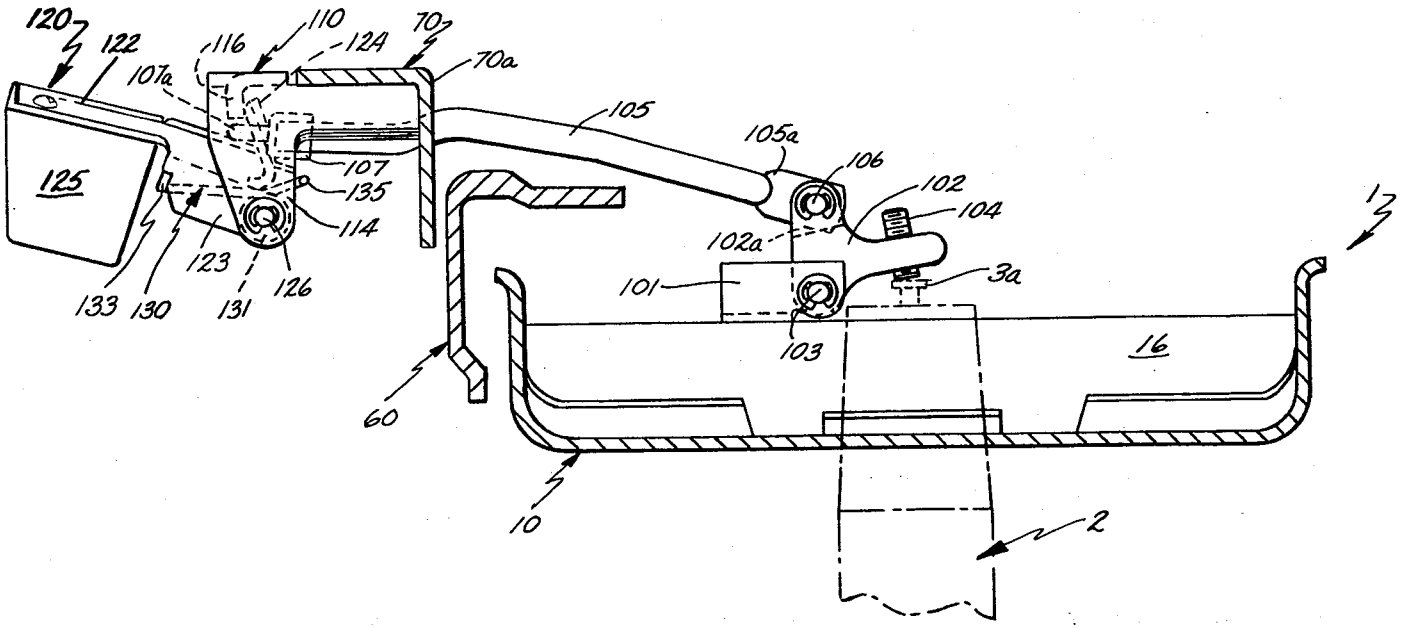
FIG. 15 is a fragmentary cross sectional view taken generally along plane XV—XV of FIG. 1, but showing only as much as the chair control as necessary to illustrate the pneumatic cylinder actuator assembly 100.

FIG. 15 provides the best illustration of pneumatic cylinder actuator assembly 100. A pivot mounting bracket 101 is welded to and is part of stationary housing 10. Specifically, it is welded on top of spindle mounting plate 16 (see also FIGS. 1 and 2). Pivot mounting bracket 101 has a pair of upwardly projecting spaced legs, each with an aperture therein to receive a pivot pin 103. Pivot pin 103 extends through a "T" shaped pivot arm 102. Thus pivot arm 102 is free to pivot about pivot 103. It is seated between the spaced legs of pivot mounting bracket 101.

Located in the extending leg of pivot arm 102 is an adjustment screw 104. Adjustment screw 104 rests on top of cylinder actuator button 3*a*.

Pivotally connected to the opposite end of the "T" cross bar of arm 102 is push rod 105. The upper end of arm 102 is grooved or notched at 102*a* (note the hidden lines in FIG. 15) and the flattened end 105*a* of push rod 105 fits down into slot or groove 102*a*. A top pivot pin 106 extends through holes in arm 102 and in the end 105*a* of push rod 105 to pivotally join the two together. Suitable retainers or clips hold pivot pins 103 and 106 in place. This interconnection is loose, allowing push rod 105 to shift slightly fore and aft of housing 10, as well as to pivot up and down.

Figure 5:
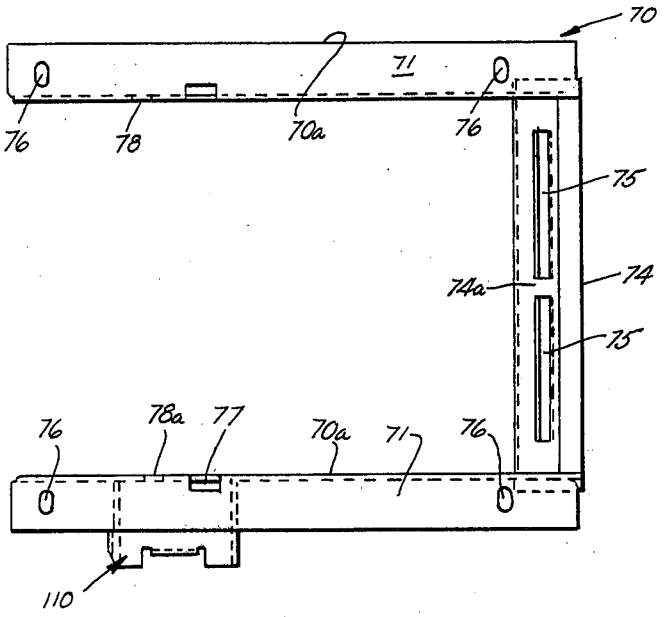
FIG. 5 is a top plan view of the chair seat supporting assembly 70.
Figure 20:
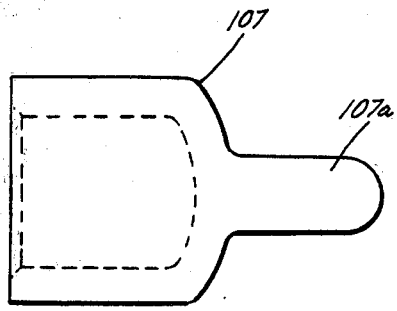
FIG. 20 is an elevational view of the push rod end cap 107.
Figure 21:
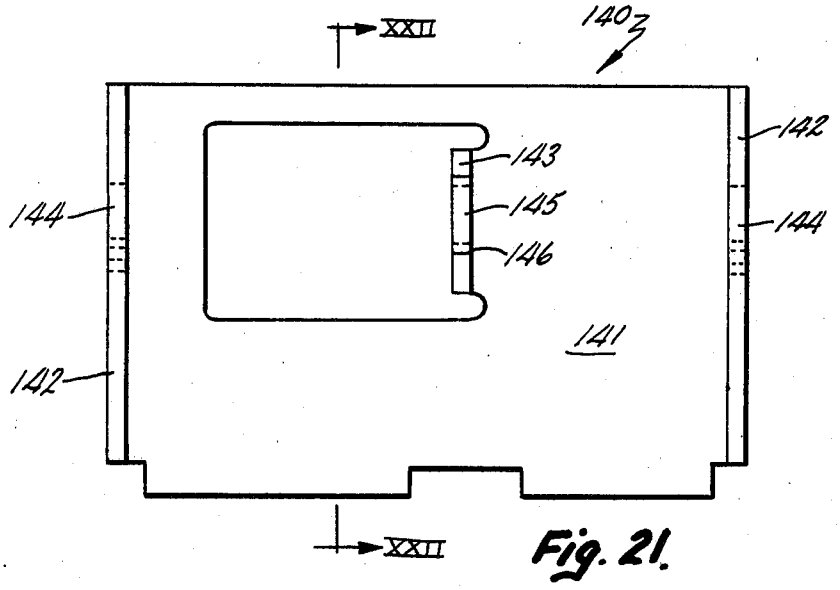
FIG. 21 is a front elevational view of the back upright lock plate 140.

Push rod 105 extends outwardly over back support arm 60 and through side hole 77 in side stretcher 70*a* (see also FIG. 5). Fitted over the projecting end of push rod 105 is a plastic end cap 107 having a projecting tip 107*a* (see also FIG. 20). Cap 107 is hollowed out as indicated by the hidden lines in FIG. 20 to receive the end of push rod 105. It is apparent that when one pushes on push rod 105, one causes arm 102 to rock downwardly and push button 3*a* downwardly, thereby actuating pneumatic cylinder 3.

It will be noted that seat support 70 is located above back support 60 in elevation, in part so that push rod 105 will extend out over one back support 60 without interfering with it (FIGS. 2–4). Indeed, back support arm 60 deviates downwardly after it goes over pivot axle 68 and then slopes back upwardly towards the front of control 1 so as to create a depression in the vicinity of push rod 105, and of control lock actuator 150, thereby insuring an absence of interference even when control 1 is tilted.

Figure 16:
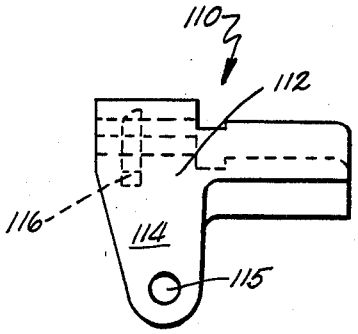
FIG. 16 is a side elevational view of the operator handle mounting bracket 110 for the pneumatic cylinder adjustment assembly 100.
Figure 17:
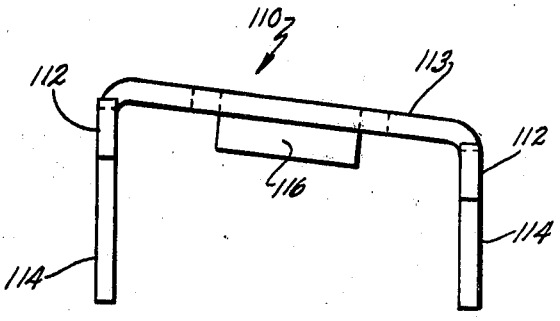
FIG. 17 is a rear elevational view thereof (right side as viewed in FIG. 16)

The pushing of push rod 105 is achieved through operator handle 120. Operator handle 120 is pivotally mounted on a handle mounting bracket 110 which in turn is welded to stretcher 70*a* (see FIGS. 1, 5 and 15). Referring to FIGS. 16 and 17, it will be seen that handle mounting bracket 110 comprises a pair of spaced side walls 112 joined by a top wall 113. Depending downwardly from the left hand (as viewed in FIG. 16) portion of mounting bracket 110 are a pair of spaced legs 114. They include apertures 115 therein to facilitate pivotal mounting of handle 120.

Figure 18:
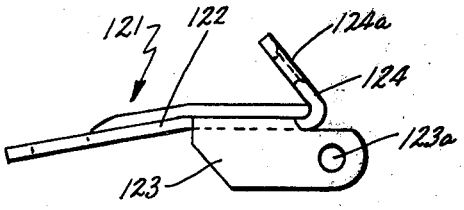
FIG. 18 is a side elevational view of the handle bracket 121.

Handle 120 comprises first of all a handle bracket 121 formed of metal, as is mounting bracket 110 (FIG. 18). Handle bracket 121 includes a top plate 122, ribbed for reinforcement and a pair of spaced, downwardly depending apertured ears 123 on either side of top plate 122. These ears 123 fit just inside the spaced legs 114 of mounting bracket 110 and a pivot pin 126 extends through apertures 123*a* and apertures 115 to thereby pivotally mount handle bracket 121 to mounting bracket 110 (FIG. 15). Suitable retainer clips hold pin 126 in place.

Projecting upwardly from top plate 122, and sloped somewhat rearwardly with respect thereto, is push plate flange 124 (FIG. 18). It includes an aperture 124*a* therein (indicated by hidden lines in FIG. 18). The projecting tip 107*a* on the end of push rod 105 projects into and through aperture 124*a* in push plate flange 124 (FIG. 15). Thus when one pushes upwardly on the handle 120, push plate flange 124 pushes push rod 105 inwardly, thereby pivoting arm 102 downwardly and depressing cylinder button 3*a*.

To facilitate pushing handle 120, an enlarged plastic button 125 is secured to the exposed under portion of top plate 122 of handle bracket 121. It will be noted that handle mounting bracket 110 includes a downwardly turned stop flange 116 along the front edge (or left edge as viewed in FIG. 15 or 16) of top plate 113 (FIGS. 16 and 17). This flange 116 serves as a stop for push plate flange 124 and thereby prevents handle 120 from falling off the tipped end 107*a* of push rod 105 (see FIG. 15).

Figure 19:
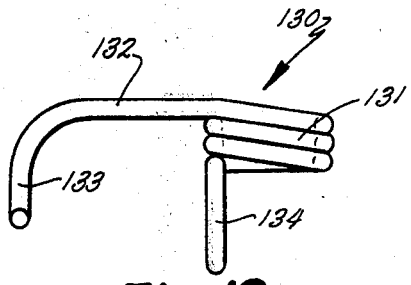
FIG. 19 is a top plan view of the handle spring 130.

Additionally, handle 120 is biased upwardly so that there is always a slight pressure against push rod 105 by means of a small spring 130 (FIGS. 15 and 19). Spring 130 is capable of biasing handle 120 against push rod 105 only with sufficient force to generate approximately 1 or 2 pounds of force on the top of cylinder button 3*a*. It takes a force of approximately 30 pounds on button 3*a* to actuate cylinder 3. Thus, the only purpose of spring 130 is to insure that handle 120 is held snuggly against the end of push rod 105 at all times.

Spring 130 comprises a coil portion 131 with a long leg 132 extending off one end of coil 131 and a short leg 134 extending off the other end (FIG. 19). The end of long leg 132 is bent laterally at 133 and the end of short leg 134 is bent downwardly as viewed in FIG. 19 such that the bent end is not visible in FIG. 19. However, in FIG. 15, it can be seen that coil 131 of spring 130 extends around pivot pin 126 and that the bent end 135 of short leg 134 wraps around the back edge of the downwardly depending leg 114 of handle mounting bracket 110. The bent end 133 of long leg 132 then wraps around the leading edge of handle 120, thereby biasing it upwardly and holding it snuggly against plastic cap 107 on the end of push rod 105.

Thus, handle 120 is pivotally mounted to seat support 70 rather than to stationary housing 10. This insures that with respect to a user in the chain seat, handle 120 will always be in the same relative location, even if seat support 70 is tilted somewhat by the user. The loose connection of the tipped end 107 of push rod 105 to push plate 124 of handle 120, and to a lesser extent the loose fit at the other end of rod 105, insures that push rod 105 won't bind up when seat support 70 is tilted.

E. LOCKING ASSEMBLY

The purpose of locking plate 140 is to lock the chair back in its upright condition, making it impossible for a person to tilt the chair and chair control 1 rearwardly. Referring to FIGS. 1, 4, 21 and 22, it will be seen that locking plate 140 comprises a rigid metal plate which has been formed to define a pair of spaced side walls 142 and a middle leg 143, all projecting in the same direction from and joined by a back wall 141. Each side wall 142 includes a keyhole opening 144 therein. Middle leg 143 simply includes a round hole 145 therein. Locking plate 140 is pivotally mounted to chair control assembly by means of rear axle 68 extending through keyholes 144 and hole 145, all of which are in alignment with one another. As can be seen by reference to FIG. 1, each axle bearing sleeve 68*a* extends inwardly sufficiently far that a portion thereof extends through each of the end openings 144 in side walls 142. As can be seen by reference to FIG. 22, each bearing sleeve 68*a* also includes a small projecting spline 68*b* which extends into the slot portion of keyhole 144. Spline 68*b* is narrower than the width of the slot portion of keyhole 144 so that lock plate 140 can be rotated about bearing 68*a*, yet spline 68*b* serves as a stop to prevent rotation beyond certain limits. The prevents plate 140 from clanking noisely against lip 15 on housing 10. Bearing sleeve 68*a* will not itself rotate relative to chair back support arms 60 in that it includes other splines 68*c* received within similar notches in the apertures 66 in arms 60 (see FIGS. 1 and 2).

Referring to FIG. 4, it can thus be seen that when locking plate 140 is rotated counterclockwise as viewed in FIG. 4, the bottom of its sidewalls 142 will come into position above the lip 15 along the rear edge of stationary housing 10. Side walls 142 are dimensioned such that when in that position, one cannot tilt back support arms 60 downwardly since the bottom edge of side walls 142 immediately comes into abutment with lip 15, or preferably into abutment with some sort of sound deadening plastic bumper, not shown in FIG. 4. When in this locking position, plate 140 is in operable engagement with stationary housing 10 in and with tilting back supports 60 in that it blocks any significant relative tilting of the two. As thus intended, the term operable engagement still allows for a slight space between plate 140 and housing 10 when the control is "at rest".

Figure 22:
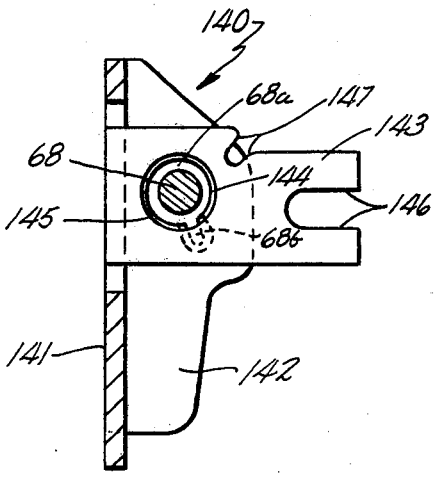
FIG. 22 is a cross sectional view thereof taken generally along plan XXII-XXII of FIG. 21, but with pivot axel 68 shown extending therethrough.

In order to facilitate rotation of lock plate 140 from its unlocked condition as shown in FIG. 4 to its locked condition as described above, a lock actuator rod 150 is provided which extends through a hole 78 in one side stretcher 70*a* (compare FIGS. 1 and 2) and is rotatably received in a similar hole 78*a* in the opposite side stretcher 70*a* (see also FIG. 5 where holes 78 and 78*a* are shown hidden). Lock actuator rod 150 includes a generally U-shaped deviation or lever or bell crank portion 151 in its central part. The base of lever or bell crank portion 151 is located within a notch 146 cut in the end of middle leg 143 of lock plate 140 (FIG. 22). Mounted on the end of lock rod 150 is an enlarged handle 152. By depressing handle 152 towards either side of its axis of pivoting, one rotates rod 150 and thereby moves bell crank 151 upwardly or downwardly. This in turn rotates lock plate 140 about rear axle 68 and facilitates movement of lock plate 140 from its locked to unlocked condition or visa-versa.

Figure 23:
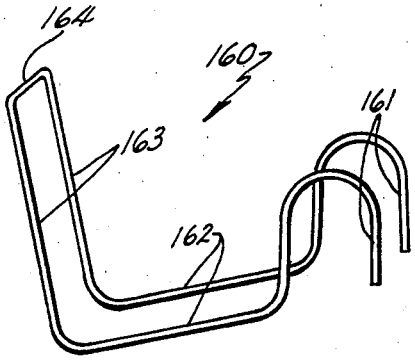
FIG. 23 is a side elevational view of the back plate spring 160.
Figure 24:
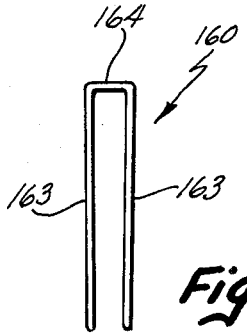
FIG. 24 is an end elevational view of said spring.

Spring 160 (FIGS. 1, 23 and 24) biases lock plate 140 and lock actuator rod 150 to either the unlocked position or locked position through an over center action. This prevents lock plate 140 from being inadvertently moved one way or the other. Referring particularly to FIGS. 23 and 24, it will be seen that spring 160 comprises a pair of open looped ends 161 which are located in side by side, spaced relationship. Each then is bent into a rearwardly extending leg 163 which in turn terminates in an upwardly bent, upwardly extending rear leg 163. Legs 163 are joined at their ends by a short bight 164. When viewed from the end (FIG. 24), spring 160 has a generally U-shaped configuration at one end, with legs 163 defining the sides of the "U". In assembly, spring 160 fits over leg 143 of back plate 140 such that bight 164 fits into a small notch 147 cut into the top of leg 143 (FIG. 22). The looped ends 161 then fit over and are preferably closed around the base of bell crank 151 of lock rod 150. Spring 160 then tends to hold lock plate 140 in either its locked or unlocked condition, depending on the position of bell crank 151.

OPERATION

With the various assemblies, sub assemblies and components thus described, the operation of chair control 1 can be more fully appreciated. As a person leans back in a chair to which chair control 1 is assembled, the chair back support arms 60 begin to pivot about their pivotal mounting (on arbor 31) to stationary housing 10. At the same time the rear of seat support stretcher assembly 80 begins to shift downwardly relative to its front since chair seat support stretcher assembly 70 is pivotally joined to back support arms 60 by rear axle 68. The front of seat support assembly 70 pivots about front axle 89 which, along with its bushings 99, slides rearwardly in tracks 20. FIGS. 2 and 3 illustrate chair control 1 in its untilted and fully tilted conditions respectively.

The various pivot points are located such that the chair back tilts rearwardly at a rate which is approximately twice as fast as the rate of tilt for the seat. Because the seat support 70 is pivotally connected directly to the back support arms 60 rather than through some sort of toggel linkage or slide, there is less sensation of the seat and back separating as one tilts rearwardly. Further, wear and tear are minimized since the only movement between the seat support 70 and back support 60 is a pivotal movement about suitable bearings. The loads imposed on the sliding bushings 99 are relatively minimal compared to the loads imposed on rear axle 68. That is because as one tips rearwardly in the chair, one tends to shift his weight to the rear of the chair and off from the front of the chair seat. As a result, there is little likelihood of bushings 99 getting hung up in track 20 or of wearing out before they have enjoyed a suitable life span.

If the chair user wishes to change the angle of the chair seat, he simply reaches under the seat, grasps gripper 92 and moves adjustment slide 90 to either the left or right, depending on which way he wants to adjust the seat angle. This movement causes upwardly projecting bolts 93 to slide in slots 75 of seat support stretcher assembly 70 and in helical slots 88 and 83 of pivot bracket inserts 86 and pivot bracket 81 respectively. Because slots 88 and 83 are helical and thus skewed slightly with respect to slots 75, such movement of bolts 93 causes pivot bracket 81 to pivot about its pivot mountings 82, which in turn changes the elevation of front axle 89 with respect to the front of seat stretcher assembly 70. This, of course, results in changing the seat angle.

If one wishes to change the height of the chair, one can reach under the chair seat and press upwardly on handle 120. This pivots handle 120 about mounting bracket 110 and causes push plate flange 124 to push against the end of push rod 105. This in turn pivots arm 102 downwardly and thereby pushes cylinder button **3*a* downwardly (FIG. 15). If the chair is unoccupied when one does this, pneumatic cylinder 3 will expand, thereby causing the chair to move upwardly. If one is seated on the chair when one does this, pneumatic cylinder 3** will contract, thereby adjusting the chair height downwardly.

If one wishes to lock the chair against any tilting motion, one simply reaches under the other side of the chair seat and pushes upwardly against the rear portion of handle 152. This twists lock actuator rod 150 and pivots bell crank 151 upwardly. This in turn pivots lock plate 140 in a counterclockwise direction as viewed in FIG. 4, thereby causing the bottom edges of lock plate side walls 142 to come into position above the lip 15 of the rear portion of stationary housing 10. This makes it impossible to pivot back support arms 60 downwardly and hence make it impossible to tilt rearwardly in the chair to which chair control 1 is mounted.

If one wishes to adjust the pretension on bias unit 30, one reaches under the front of chair control 1 and grasps button 51, pulls lever 47 down past lip 56 and pivots lever 47 into slot **43*a* in the side of bolt 40*a*. By then rotating lever 47, one threads bolt 40*a* in threaded retainer 59. This pulls down on, or alternatively eases off on, the ends 32*a* of coil springs 32** and thereby changes the tension thereon.

Of course, it is understood that the above is merely a preferred embodiment of the invention and that various changes and alterations can be made without departing from the spirit and broader aspects thereof as more particularly defined in the appended claims.

The embodiments of the present invention in which an exclusive property or privilege is claimed are defined as follows.

1. In a synchrotilt chair control having a stationary control housing, resilient biasing means mounted in said stationary control housing, chair back support means pivotally mounted on said stationary control housing and operably interconnected with said resilient biasing means, and chair seat support means mounted on said stationary control housing and operably connected to said chair back support means for rearward tilting with said chair back support means, but at a different rate with respect thereto, against the biasing action of said resilient biasing means in response to a person leaning back in a chair to which said control is mounted, the improvement comprising; said stationary housing including track means; said seat support means being pivotally connected directly to said chair back support means and including first pivot axis means slidably mounted in said track means whereby said seat support means is free to shift relative to said stationary housing when a user tilts rearwardly in a chair mounted on such chair control; seat adjustment means including a pivot bracket pivotally mounted to said first pivot axis means and to said seat support means on a second pivot axis; whereby said seat adjustment means can be actuated to rotate said pivot bracket about said second pivot axis, thereby sliding said first pivot axis means in said track means, and changing the relative elevation of said first pivot axis means with respect thereto and thereby changing the pitch of said seat support means with respect to said stationary housing, whereby said first pivot axis means being slidably mounted in said track means not only allows said seat support means to freely shift relative to said stationary housing when a user tilts rearwardly in a chair mounted on such a chair control, but also allows said seat adjustment means to be shifted and change the pitch of said seat support means.

2. The chair control of claim 1 in which said track means comprise; a pair of spaced track brackets mounted on the front of said stationary control housing and projecting forwardly therefrom, each said track bracket comprising: a flat top wall and a flat bottom wall joined by a front wall; said first pivot axis means comprising an axle mounted in bushings which are slidably located between said top and bottom walls of said track brackets, such that said bushings slide in said track brackets.

3. The chair control of claim 1 or 2 comprising: said stationary control housing having spaced side walls; said resilient bias means comprising a torsion means extending between said spaced side walls of said stationary control housing and having portions extending through and beyond said side walls, said extending portions being generally in alignment with the torsional axis of said torsion means; said chair back support means comprising a separate lever arm mounted on either side of and to the outside of said stationary control housing on said extending portions of torsion means so as to pivot about said torsional axis; said seat support means comprising a pair of spaced stretchers mounted to the outside of said back support means and said stationary control housing.

4. The chair control of claim 3 comprising: said stationary member being generally dish shaped in configuration with said resilient biasing means being mounted within said dish and thereby generally concealed from view.

5. The chair control of claim 1 or 2 in which said slide includes a gripping flange projecting downwardly therefrom whereby a user can readily grasp said gripping flange and slide said slide one way or another.

6. The chair control of claim 1 or 2 in which said seat support member includes a wall having a generally rectilinear slot therein extending generally laterally with respect to the sides of said seat support member; said projection means on said slide extending through said generally rectilinear slot.

7. The chair control of claim 6 in which said projection means includes a locating shoulder of generally rectangular lateral cross section with sides oriented generally parallel to said generally rectilinear slot, said shoulder being received in said generally rectilinear slot; said projection means including a second shoulder of generally rectangular lateral cross section and having sides oriented at an angle with respect to said sides of said first shoulder and generally parallel to the sides of said helical slot as projected into a plane, said second shoulder being received within said helical slot.

8. The chair control of claim 7 comprising: a molded plastic insert of semi-cylindrical configuration corresponding to the configuration of said cylindrical wall and being seated therein, said insert including a helical slot therein aligned with said helical slot in said cylindrical wall; said helical slot in said plastic insert including a lip extending peripherally there around and projecting downwardly from the generally cylindrical configuration of said insert, said lip fitting into and covering the edges of said helical slot in said cylindrical wall.

9. The chair control of claim 8 comprising: a plastic washer of semi-cylindrical vertical cross section positioned on the end of said projection means and being seated within said plastic insert; means securing said plastic washer on said end of said projection means.

10. The chair control of claim 6 in which said slide comprises a molded plastic member and said projection means comprises a shoulder bolt having a head imbedded in said plastic slide.

11. The chair control of claim 7 in which said slide is a molded plastic member and said projection means comprises a shoulder bolt having a head imbedded in said plastic slide; said first shoulder being integrally molded of plastic with said slide and surrounding said shoulder bolt; said second shoulder comprising the shoulder of said shoulder bolt.

12. The chair control of claim 5 comprising: said stationary control housing having spaced side walls; said resilient bias means comprising a torsion means extending between said spaced side walls of said stationary control housing and having portions extending through and beyond said side walls, said extending portions being generally in alignment with the torsional axis of said torsion means; said chair back support means comprising a separate lever arm mounted on either side of and to the outside of said stationary control housing on said extending portions of torsion means so as to pivot about said torsional axis; said seat support means comprising a pair of spaced stretchers mounted to the outside of said back support means and said stationary control housing.

13. The chair control of claim 6 comprising: said stationary control housing having spaced side walls; said resilient bias means comprising a torsion means extending between said spaced side walls of said stationary control housing and having portions extending through and beyond said side walls, said extending portions being generally in alignment with the torsional axis of said torsion means; said chair back support means comprising a separate lever arm mounted on either side of and to the outside of said stationary control housing on said extending portions of torsion means so as to pivot about said torsional axis; said seat support means comprising a pair of spaced stretchers mounted to the outside of said back support means and said stationary control housing.

14. The chair control of claim 1 in which said pivot bracket is generally U-shaped, comprising a pair of spaced side walls joined by said cylindrical wall, said first and second pivot axes extending through said side walls of said pivot bracket.

15. The chair control of claim 14 in which there are two of said helical slots in said cylindrical wall, said slots being spaced laterally from one another with respect to said side walls and being oriented generally parallel to one another; there being two of said projection means on said slide, one projecting through each of said helical slots.

16. The chair control of claim 1 in which a rear pivot axle extends between said seat support means and said back support means, said rear pivot axle comprising said pivotal connection of said seat support means directly to said back support means; a rigid member pivotally mounted on said rear pivot axle; actuator means mounted on said chair control and operably connected to said rigid member for pivoting said rigid member between a locking position and an unlocking position, said rigid member being of such a configuration and having such an oreintation in its mounting to said chair control that when in said locking position, it extends from said rear pivot axle to a position of operable engagement with said stationary control housing, thereby preventing relative movement of the two, and such that when in said unlocking position, it is out of operable engagement with one of said tiltable and stationary members whereby said tiltable member can tilt with respect to said stationary member.

17. The chair control of claim 16 which includes stop means positioned to abut said rigid member and stop it, as it is moved towards said locking position, at a point just short of physical engagement with said one member whereby movement of said rigid member into said locking position will not cause it to clank noisely against said one member.

18. The chair control of claim 17 in which said stop means comprises: said rigid member including a keyhole opening, said rear pivot axle passing through the enlarged portion of said keyhole opening and including a spline extending into the slot of said keyhole opening, said rear pivot axle and said spline being held against rotation and said spline being smaller in width than the width of said slot of said keyhole whereby said rigid member can be pivoted about said rear pivot axle from the point of engagement of said spline with one side of said slot to the point of engagement of said spline with the other side of said slot.

19. The chair control of claim 18 in which said spline is integrally molded of plastic with a sleeve which fits onto said pivot axle whereby the engagement of said keyhole slot with said spline is relatively noise free.

20. The chair control of claim 19 in which said actuator means is pivotally mounted on said seat support means.

21. The chair control of claim 18 or 20 in which said actuator means comprises: a pivotally mounted rod having a deviation therein defining a lever, said lever engaging said rigid member and pivoting said rigid member when said rod is twisted.

22. The chair control of claim 21 in which said rigid member includes a leg projecting laterally of said pivot axle and having a slot therein which engages said lever of said actuator rod.

23. The chair control of claim 21 in which said slot in said leg is open ended whereby said lever of said actuator rod can be slid readily into engagement with said slot.

24. The chair control of claim 23 which comprises: spring means operably mounted between said lever of said actuator rod and said rigid member for biasing said rigid member towards either its locking or unlocking position.

25. The chair control of claim 24 in which said spring means operably engages said actuator rod on its axis of rotation and operably engages and pushes against said rigid member at point which moves through a plane extending from the axis of rotation of said actuator rod and the axis of rotation of said rigid member as said rigid member is shifted between its locking and unlocking positions.

26. The chair control of claim 25 in which said rigid member leg includes a notch therein, said spring means being seated in said notch.

27. The chair control of claim 16 or 17 in which said actuator means comprises: a pivotally mounted rod having a deviation therein defining a lever, said lever engaging said rigid member and pivoting said rigid member when said rod is twisted.

28. The chair control of claim 27 in which said actuator rod is pivotally mounted on said seat support means; said seat support means being positioned on a higher elevation than said back support means whereby said actuator rod extends over said back support means.

29. The chair control of claim 28 in which said back support means deviates downwardly and forwardly from its mounting on said rear pivot axle and then slopes forwardly and upwardly to its pivotal mounting to said stationary control housing, thereby defining a depression; the pivot axis of said actuator rod extending over said depression in said back support means.

30. The chair control of claim 27 in which said rigid member includes a leg projecting laterally of said pivot axle and having a slot therein which engages said lever of said actuator rod.

31. The chair control of claim 30 in which said slot in said leg is opened ended whereby said lever of said actuator rod can be slid readily into engagement with said slot.

32. The chair control of claim 31 which comprises: spring means operably mounted between said lever of said actuator rod and said rigid member for biasing said rigid member towards either its locking or unlocking position.

33. The chair control of claim 32 in which said spring means operably engages said actuator rod on its axis of rotation and operably engages and pushes against said rigid member at a point which moves through a plane extending from the axis of rotation of said actuator rod and the axis of rotation of said rigid member as said rigid member is shifted between its locking and unlocking positions.

34. The chair control of claim 33 in which said rigid member leg includes a notch therein, said spring means being seated in said notch.

35. The chair control of claim 34 in which said spring comprises a pair of looped ends looped around said actuator rod on its axis of rotation, a rearwardly extending leg extending rearwardly from each of said looped ends, an upwardly extending leg extending upwardly from each of said rearwardly extending legs and a bight portion joining the ends of said upwardly extending legs, said bight portion being seated in said notch of said leg on said rigid member.

36. The chair control of claim 27 in which said rigid member further includes a pair of spaced end legs which extend over the rear edge of said stationary member when said rigid member is in its locking position, said end legs comprising that portion of said rigid member which are in operable enggement with said stationary member when said rigid member is in its locking position, said rear legs being positioned in very close proximity to the rear of said stationary member but being spaced slightly therefrom whereby they do not clank noisely against said stationary member when said rigid member is moved into its locking position.

37. The chair control of claims 1, 2, 15, 16, 17 or 18 in which said stationary member has mounting means for securing to the top of a height adjustable chair base, which base has a height adjustment actuator at the top thereof, the improvement comprising: linkage means pivotally mounted at one end adjacent said mounting means whereby when said chair control is located in place atop a chair base, the height adjustment actuator of said chair base is engaged by said linkage means; said linkage means being pivotally connected at its other end to said tilting member of said chair control and extending to the exterior of said tilting member; handle means operably connected to said extending end of said linkage means whereby a user seated in a chair to which said chair control is secured can readily actuate the height adjustment actuator on a chair base mounted underneath said chair control by reaching under said chair and activating said handle; said seat support means being positioned on a higher elevation than said back support means whereby said linkage means extends over said back support means.

38. The chair control of claim 37 in which said handle is pivotally mounted directly on said tilting member whereby its position relative to said tilting member and to a chair seat mounted on said tilting member never changes.

39. The chair control of claim 38 in which said linkage means includes a rod, said handle including a push plate engaging the end of said rod whereby when one pushes on said handle, said push plate pushes said rod.

40. The chair control of claim 39 which includes a tip smaller in cross section than said rod and projecting from the end of said rod; said push plate on said handle including an aperture therein through which said tip projects to thereby hold said rod in position with respect to said push plate.

41. The chair control of claim 40 in which said tip is part of a plastic cap which seats over the end of said rod.

42. The chair control of claim 38 in which said back support means deviates downwardly and forwardly from its mounting on said rear pivot axle and then slopes forwardly and upwardly to its pivotal mounting to said stationary control housing, thereby defining a depression; said linkage means extending over said depression.

43. The chair control of claim 38 in which bias means connected to said handle biases said push plate towards engagement with said end of said rod.

44. The chair control of claim 38 in which said linkage means includes an arm of generally T-shaped configuration, having a cross bar and a stem; one end of said cross bar being pivotally mounted to said mounting means and the other being loosely, pivotally connected to said rod; said stem of said T projecting from said cross bar and over an opening in said mounting means through which the height adjusting actuator of a chair base ends when said chair control is mounted on such a chair base.

45. The chair control of claim 44 in which said stem includes a screw threaded laterally therethrough for pushing against said height adjustment actuator whereby one can adjust the action of said arm against the height adjustment actuator by threading said screw upwardly or downwardly in said stem.

46. The chair control of claim 37 in which said back support means deviates downwardly and forwardly from its mounting on said rear pivot axle and then slopes forwardly and upwardly to its pivotal mounting to said stationary control housing, thereby defining a depression; said linkage means extending over said depression.

47. The chair control of claim 37 in which a threaded member is operably connected to the bias means and a bolt is threaded in the threaded member whereby tightening or loosening said bolt changes the pretension on the bias means, the improvement in said chair control comprising: said bolt having a hollow shank with an open end, a lever being telescopically received in said hollow shank and projecting from said open end, means on said bolt engagable by said lever when said lever is retracted from said hollow shank and pivoted to a generally lateral position with respect to said bolt; means preventing said lever from being completely removed and separated from said bolt when it is retracted from said hollow shank; retainer means on said bolt normally holding said lever in a stored position within said hollow shank, said retainer means being adapted to yield upon application of manual force to allow said lever to be withdrawn from said hollow shank and pivoted to its lateral position engaging said engagable means on said bolt.

48. The chair control of claim 47 in which said retainer means comprising a molded plastic retainer cap seated on the end of said hollow shank and including an aperture therein through which said lever passes.

49. The chair control of claim 48 in which said plastic cap includes generally annular inwardly projecting retainer lip means extending at least partially around said aperture in said retainer cap and which engages at least a portion of said lever to normally hold said lever in said stored position within said hollow shank, but which yields when one pulls on said lever to allow said lever to be withdrawn from said hollow shank and rotated to its generally lateral position with respect to said bolt.

50. The chair control of claim 49 in which said lever includes an annular projecting rib towards that end thereof which is located near said open end in said hollow shank when said lever is in its normally stored position within said hollow shank, said annular rib being engaged by said annular inwardly projecting lips of said retainer cap when said lever is in its normally stored position within said hollow shank.

51. The chair control of claim 50 in which said annular inwardly projecting lip means protrudes downwardly from said cap, with respect to the position of said cap when said chair control is installed on a chair, and then protrudes inwardly whereby said annular lip is rendered more yieldable when one pulls said annular rib of said lever past said lip.

52. The chair control of claim 51 in which said lever includes a molded plastic gripping cap on that end thereof which is located outside of said hollow shank of said bolt whereby one can readily grip said lever and manipulate it.

53. The chair control of claim 52 in which said gripping cap includes a recess in that surface thereof which is oriented towards said retainer cap, said recess being adapted to receive said protruding lip and conceal same from view when said lever is in its normally stored position within said hollow shank of said bolt.

54. The chair control of claim 47 in which said means engagable by said lever when said lever is rotated to a lateral position with respect to said bolt comprise a longitudinal slot extending from said open end in said hollow shank down the side of said shank.

55. The chair control of claim 54 in which said lever includes a retainer head on that end thereof which is located within said hollow shank, said retainer head having a cross section which is enlarged with respect to the rest of the cross section of said lever; said bolt including a slotted retainer washer secured at and defining said open end of said hollow shank, said washer allowing said lever to be moved in and out of said hollow shank, but having an opening sufficiently small that it will not allow said retainer head to pass, the slot of said washer comprising a portion of said slot which extends from said open end of said hollow shank down the side of said hollow shank.

56. The chair control of claim 55 in which said retainer means comprising a molded plastic retainer cap seated on the end of said hollow shank and including an aperture therein through which said lever passes.

57. The chair control of claim 56 in which said retainer cap includes an elongated slot extending from its aperture at least part of the way down the side thereof, which slot is aligned with said slot in said hollow shank of said bolt.

58. The chair control of claim 57 in which said hollow shank of said bolt includes a second slot generally in one side thereof, but not communicating with said open end of said hollow shank, said retainer cap including an inwardly projecting tab which seats in said second slot to properly orient said retainer cap on said hollow shank with said slot of said retainer cap in alignment with said first slot in said hollow shank.

59. The chair control of claim 1, 2, 15, 16, 17 or 18 in which a threaded member is operably connected to the bias means and a bolt is threaded in the threaded member whereby tightening or loosening said bolt changes the pretension on the bias means, the improvement in said chair control comprising: said bolt having a hollow shank with an open end, a lever being telescopically received in said hollow shank and projecting from said open end, means on said bolt engagable by said lever when said lever is retracted from said hollow shank and pivoted to a generally lateral position with respect to said bolt; means preventing said lever from being completely removed and separated from said bolt when it is retracted from said hollow shank; retainer means on said bolt normally holding said lever in a stored position within said hollow shank, said retainer means being adapted to yield upon application of manual force to allow said lever to be withdrawn from said hollow shank and pivoted to its lateral position engaging said engagable means on said bolt.

60. The chair control of claim 59 in which said retainer means comprising a molded plastic retainer cap seated on the end of said hollow shank and including an aperture therein through which said lever passes.

61. The chair control of claim 60 in which said plastic cap includes generally annular inwardly projecting retainer lip means extending at least partially around said aperture in said retainer cap and which engages at least a portion of said lever to normally hold said lever in said stored position within said hollow shank, but which yields when one pulls on said lever to allow said lever to be withdrawn from said hollow shank and rotated to its generally lateral position with respect to said bolt.

62. The chair control of claim 61 in which said lever includes an annular projecting rib towards that end thereof which is located near said open end in said hollow shank when said lever is in its normally stored position within said hollow shank, said annular rib being engaged by said annular inwardly projecting lips of said retainer cap when said lever is in its normally stored position within said hollow shank.

63. The chair control of claim 62 in which said annular inwardly projecting lip means protrudes downwardly from said cap, with respect to the position of said cap when said chair control is installed on a chair, and then protrudes inwardly whereby said annular lip is rendered more yieldable when one pulls said annular rib of said lever past said lip.

64. The chair control of claim 63 in which said lever includes a molded plastic gripping cap on that end thereof which is located outside of said hollow shank of said bolt whereby one can readily grip said lever and manipulate it.

65. The chair control of claim 64 in which said gripping cap includes a recess in that surface thereof which is oriented towards said retainer cap, said recess being adapted to receive said protruding lip and conceal same from view when said lever is in its normally stored position within said hollow shank of said bolt.

66. The chair control of claim 1, wherein: said seat support means having a forward portion located towards the front of a seat of a chair, and having a rearward portion located towards the rear of such a chair seat; said seat support means being pivotally connected to said chair back support means at the rearward portion of said chair; said first pivot axis means slidably mounted in said track means at said forward portions of said seat support means; and wherein said pivot bracket includes a cylindrical wall extending generally laterally with respect to the sides of said seat support member, said cylindrical wall defining at least a portion of the wall of a right circular cylinder whose axis of revolution lies on said second pivot axis; said cylindrical wall including at least one helically oriented slot therein; a slide slidably mounted on said seat support member for generally lateral movement with respect to the sides of said seat support member, said slide including projection means projecting through said helical slot in said cylindrical wall whereby as said slide is moved laterally, said seat adjustment means is actuated to rotate said pivot bracket about said second pivot axis.

* * * * *

UNITED STATES PATENT AND TRADEMARK OFFICE

CERTIFICATE OF CORRECTION

PATENT NO. : 4,390,206

DATED : June 28, 1983

INVENTOR(S) : Frederick S. Faiks, et al.

It is certified that error appears in the above-identified patent and that said Letters Patent is hereby corrected as shown below:

Front Cover:
Assignee: "Steelcase, Incorporated" should be --Steelcase Inc.--

Column 1, line 51:
"toggel" should be --toggle--

Column 2, line 18:
"toggel" should be --toggle--

Column 3, line 22:
"alone" should be --along--

Column 3, line 24:
"alone" should be --along--

Column 3, line 32:
"as" second occurrence should be --of--

Column 3, line 48:
"axel" should be --axle--

Column 5, line 16:
"arbor 30" should be --arbor 31--

Column 5, line 18:
"arbor 30" should be --arbor 31--

Column 5, line 20:
"arbor 30" should be --arbor 31--

UNITED STATES PATENT AND TRADEMARK OFFICE

CERTIFICATE OF CORRECTION

PATENT NO. : 4,390,206

DATED : June 28, 1983

INVENTOR(S) : Frederick S. Faiks, et al.

It is certified that error appears in the above-identified patent and that said Letters Patent is hereby corrected as shown below:

Column 6, line 38:
"alo" should be --also--

Column 6, line 43:
"snuggly" should be --snugly--

Column 6, line 53:
"snuggly" should be --snugly--

Column 9, line 14:
"snuggly" should be --snugly--

Column 9, line 23:
"snuggly" should be --snugly--

Column 11, line 18:
"snuggly" should be --snugly--

Column 11, line 32:
"snuggly" should be --snugly--

Column 11, line 68:
"The" should be --This--

Column 12, line 40:
"visa-versa" should be --vice versa--

Column 13, line 2:
"80" should be --70--

Column 13, line 15:
"toggel" should be --toggle--

UNITED STATES PATENT AND TRADEMARK OFFICE

CERTIFICATE OF CORRECTION

PATENT NO. : 4,390,206

DATED : June 28, 1983

INVENTOR(S) : Frederick S. Faiks, et al.

It is certified that error appears in the above-identified patent and that said Letters Patent is hereby corrected as shown below:

Column 14, Claim 2, line 50:
"1" should be --66--

Column 14, Claim 3, line 60"
"1 or 2" should be --66--

Column 15, Claim 5, line 12:
"1 or 2" should be --66--

Column 15, Claim 6, line 16:
"1 or 2" should be --66--

Column 16, Claim 14, line 21:
"1" should be --66--

Column 16, Claim 16, line 33:
"1" should be --66--

Column 18, Claim 37, line 33:
"1, 2, 15, 16, 17 or 18" should be --66--

Column 20, Claim 59, line 65:
"1, 2, 15, 16, 17 or 18" should be --66--

Column 16, Claim 16, line 43:
"oreintation" should be --orientation--

Column 16, Claim 17, line 57:
"noisely" should be --noisily--

Column 17, Claim 31, line 61:
"opened ended" should be --open ended--

UNITED STATES PATENT AND TRADEMARK OFFICE

CERTIFICATE OF CORRECTION

PATENT NO. : 4,390,206

DATED : June 28, 1983

INVENTOR(S) : Frederick S. Faiks, et al.

It is certified that error appears in the above-identified patent and that said Letters Patent is hereby corrected as shown below:

Column 18, Claim 36, line 26:
"enggement" should be --engagement--

Column 18, Claim 36, line 31:
"noisely" should be --noisily--

Column 20, Claim 56, line 48:
"comprising" should be --comprises--

Column 21, Claim 60, line 17:
"comprising" should be --comprises--

Column 11, line 68:
"noisely" should be --noisily--

Signed and Sealed this

*Twenty-ninth* Day of *November 1983*

[SEAL]

*Attest:*

GERALD J. MOSSINGHOFF

*Attesting Officer* *Commissioner of Patents and Trademarks*